United States Patent [19]

Allen

[11] 4,408,960

[45] Oct. 11, 1983

[54] PNEUMATIC METHOD AND APPARATUS FOR CIRCULATING LIQUIDS

[75] Inventor: Paul E. Allen, Newtown, Conn.

[73] Assignee: Logic Devices, Inc., Bethel, Conn.

[21] Appl. No.: 301,358

[22] Filed: Sep. 11, 1981

[51] Int. Cl.[3] ..... F04F 1/02

[52] U.S. Cl. ..... 417/54; 417/125; 417/149

[58] Field of Search ..... 417/122–125, 417/54, 149; 425/552

[56] References Cited

U.S. PATENT DOCUMENTS

| | | | |
|---|---|---|---|
| 580,745 | 4/1897 | Wilson | 417/125 |
| 3,883,269 | 5/1975 | Wolf | 417/149 |
| 4,086,765 | 5/1978 | Gillilan | 417/125 X |
| 4,323,452 | 4/1982 | Witzenberg | 417/123 |

*Primary Examiner*—Richard E. Gluck
*Attorney, Agent, or Firm*—Cifelli, Frederick & Tully

[57] ABSTRACT

A pneumatic method and apparatus for causing the rapid recirculation of a liquid between a plurality of containers 10, 11 by adjusting the pressure of a gas exerted within each of said containers to superatmospheric, atmospheric and subatmospheric pressures, thereby avoiding the passing of the liquid through a mechanical flow-inducing pump. The containers 10, 11 are connected to each other by means of a liquid circulation system comprising a circulation conduit which includes a work station. A filled first container 10 is subjected to superatmospheric pressure to force the liquid into the circulation system while a second empty container 11 is subjected to subatmospheric pressure to suck the liquid from the circulation system. After each container is empty and before it is subjected to subatmospheric pressure, for refilling purposes, it is exposed to atmospheric pressure to release the elevated pressure therefrom. The circulation system preferably incorporates a bypass conduit 46 including a liquid replenishment tank 38 and/or means 39 for adjusting the temperature of the liquid.

21 Claims, 4 Drawing Figures

| SEQUENCE OF OPERATION | | | | |
|---|---|---|---|---|
| VALVE | 26 | 23 | 24 | 27 |
| FLOW CONTAINER 10 TO 11 | − | + | − | + |
| INTERIM PERIOD | − | + | + | − |
| FLOW CONTAINER 11 TO 10 | + | − | + | − |
| INTERIM PERIOD | − | + | + | − |

| | 66 | 67 | 71 | 72 | 75 | 76 |
|---|---|---|---|---|---|---|
| 53 FULL (VACUUM)<br>54 EMPTY (ATMOS. PRESSURE)<br>INTERIM | + | − | − | − | − | + |
| 53 PRESSURIZED<br>+ DISPENSING<br>54 VACUUM<br>+ FILLING | − | + | + | − | − | − |
| 53 EMPTY (ATMOS. PRESSURE)<br>54 FULL (VACUUM)<br>INTERIM | − | + | − | − | + | − |
| 53 VACUUM<br>+ FILLING<br>54 PRESSURIZED<br>+ DISPENSING | + | − | − | + | − | − |

PNEUMATIC METHOD AND APPARATUS FOR CIRCULATING LIQUIDS

BACKGROUND OF THE INVENTION

The present invention is primarily concerned with the field of molding and, more particularly, with the problems encountered with systems which circulate heat-transfer liquids such as hot oils through a mold during the process of molding plastics or other materials in said mold. It is not uncommon for such heating liquids to have a temperature in the area of 450° F., and it has been found that the circulation of such hot liquids has a deleterious effect upon the mechanical circulation pumps through which the liquids must pass. Pumps suitable for use with such liquids are very expensive and have a relatively short life before leakage occurs due to heat-damage of the seals therein. Also, many such pumps are designed to permit the slow leakage of the hot oil for purposes of lubricating the pump. Such leakage is messy and causes a contamination of the atmosphere due to vaporization.

It is also known to circulate cryogenic liquids for cooling or freezing purposes, and to circulate corrosive liquids such as acidic and alkaline liquids through pumps which must be espcially made for such uses and which are expensive and have relatively short lives under the conditions of use.

In many cases a compromise is made with respect to the effectiveness of the work station by moderating the temperature of the circulation liquid. However, this generally results in longer dwell times in the work station, decreased productivity and/or inferior products produced at the work station. It is also known to employ cooling bearings on pumps subjected to elevated temperatures in order to cool said pumps and prevent or retard heat damage thereto. However, such bearings are relatively expensive and require the circulation of coolant therethrough.

SUMMARY OF THE INVENTION

The present invention involves a novel system and apparatus for circulating a liquid through a work station without causing said liquid to pass through a flow-inducing element such as a mechanical pump which might be damaged by said liquid. This is accomplished by providing a plurality of containers, at least one being a filled first supply container adapted to supply the liquid to the work station and an other being an empty second or receptor container adapted to receive the liquid from the work station, and by providing means for alternating the gas pressure within said container(s) between a higher pressure, when said container is full and being emptied, atmospheric pressure to relieve the higher pressure, and a lower pressure, when said container is empty and being filled, whereby said liquid is pushed and pulled to cause it to circulate from the supply container to the receptor container, passing through the work station, without the liquid ever passing through a flow-inducing element such as a mechanical pump. Most preferably, the present liquid circulation system also includes a liquid circulation reservoir comprising an accumulator tank or reservoir which is maintained under a reduced pressure below the said higher pressure so as to receive at least the excess circulation liquid from the work station when the pressure within said supply container is being alternated, and which opens to and discharges said liquid into the receptor container having the reduced pressure when said reduced pressure becomes sufficiently low to overcome the reduced pressure within the reservoir. The reservoir is open to the supply container when the latter is under reduced pressure, so as to permit the circulation liquid to flow from the reservoir into said container. This permits circulation of the liquid by means of alternation of the pressure and avoids the need for a mechanical pump.

A preferred embodiment of the present invention involves a pneumatic system and apparatus in which the air pressure within the two liquid supply and receptor containers is adjusted between higher and lower pressures which are only slightly greater than, equal to or slightly lower than atmospheric pressure, whereby the danger of leakage or explosion involved in a high pressure circulation system for hot or corrosive liquids is avoided and leakage of the liquid through any cracks present in the mold is minimized or, in the case of negative pressure, avoided.

DETAILED DESCRIPTION

Figure 1:
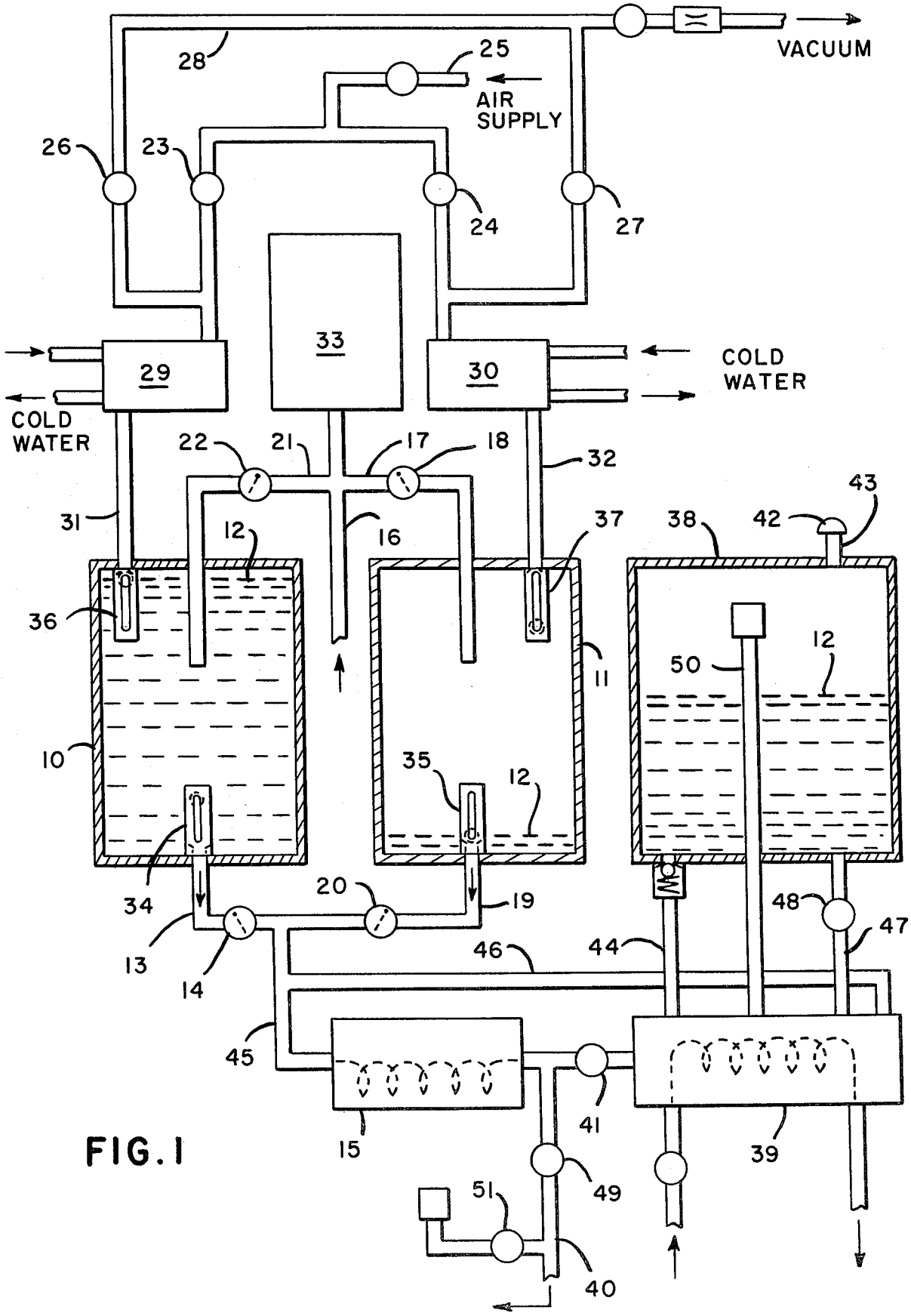
FIG. 1 is diagrammatic illustration of a system according to a preferred embodiment of the present invention.

Referring to the drawings, FIG. 1 illustrates a preferred apparatus according to the present invention which includes two supply/receptor containers 10 and 11, container 10 being illustrated in substantially filled condition and pressurized and in the process of supplying liquid 12, such as hot oil, through a discharge conduit 13 including a check valve 14 and through a heater 15 to a mold, not shown. After passing through the mold heating conditions to heat the mold, as desired, the liquid returns to the system through a return line 16 and is selectively drawn into the container 11 through the inlet conduit section 17 including check valve 18, container 11 being illustrated in substantially empty condition and under reduced pressure and in the process of receiving liquid 12 which has returned from the mold.

When substantially all of the liquid 12 passes from container 10, through the heater 15 and the mold and returns to the container 11, the pressure condition within the containers 10 and 11 is reversed, i.e., container 11 is pressurized and container 10 is subjected to a vacuum, whereby the liquid 12 is discharged from pressurized container 11 through discharge conduit 19 including a check valve 20 and through the heater 15 to the mold. The liquid returns from the mold through return line 16 and is selectively drawn into the reduced pressure container 10 through the inlet conduit section 21 including its check valve 22.

It is clear from the foregoing that the liquid 12 is circulated continuously from one container, through a work station and back to another container without ever passing through any mechanical flow inducing element or pump. This is of great advantage in cases where the liquid is at such high or low temperature, or is so corrosive or otherwise represents a threat to the operation of a pump or its leak-resistance that it is necessary or desirable to avoid the need to pass the liquid through a pump in order to obtain continuous circulation.

In the apparatus of FIG. 1, both supply/receptor containers 10 and 11 are connected by common conduits to the heater 15 and mold conduit and also to the return line 16, but the supply of liquid directly from one container to the other and the return of liquid to both containers simultaneously is precluded by the presence of pressure-sensitive check valves 14, 18, 20 and 22.

As illustrated by FIG. 1, the pressure and vacuum conduitions created alternately in the containers 10 and 11 are controlled by solenoid valves 23 and 24 which connect a pressurized air supply conduit 25 to each of the containers 10 and 11, and solenoid valves 26 and 27 which connect a vacuum conduit 28 to each of the containers 10 and 11. The connection to containers 10 and 11 is through water-cooled condensers 29 and 30 and conduit connections 31 and 32 respectively, the condensers being advantageous in systems employing hot circulation liquids which may tend to vaporize and be drawn into the vacuum conduit 28. Such vapors are condensed and returned to the containers by gravity flow. This also protects the solenoid valves 23, 24, 26 and 27 against exposure to high heat.

The apparatus of FIG. 1 also illustrates the presence of a liquid reservoir or accumulator tank 33 which is open to both return conduits 17 and 21 and to the return line 16 so as to be exposed to the alternate vacuum pressures existing in containers 10 and 11. The accumulator tank 33 is at a higher elevation than the return conduits 17 and 21 so that it does not receive any of the circulating liquid unless and until the receiving container 10 or 11 is filled to capacity or until both containers 10 and 11 are pressurized during the momentary pause before the previously pressurized container 10 or 11 is opened to the vacuum conduit 28. During said pause of one or two seconds, the accumulator tank 33 is still under vacuum induced by previous exposure to the container 10 or 11 which was under vacuum conditions in the just-completed cycle and is isolated from the now-pressurized containers 10 and 11 by the check valves 18 and 22 which only permit flow into the containers when the pressure within the containers 10 or 11 is less than the pressure in the intake conduits 17 and 21 on the intake side of the valves 18 and 22. During said interim period the lowest pressure in the system exists in the accumulator tank 33 and, therefore, the liquid returning from the mold via the return line 16 will be drawn into the tank 33 until the empty container 10 and 11 is opened to the vacuum line to convert it from pressurized to vacuum condition. As soon as the vacuum pressure within said container is reduced to a value below the degree of vacuum pressure within the accumulator tank 33, the flow control valve to said container, either 18 or 22, opens to permit the liquid from the accumulator tank 33 to flow into the vacuum container 10 or 11 and to permit the liquid returning from the mold via line 16 to flow directly into the vacuum container. Thus, the tank 33 permits the continuous circulation of the liquid even while the containers are being changed over from pressurized supply condition to vacuum/receptor condition and prevents the build-up of pressure in the return line 16 and intake conduits 17 and 21.

The apparatus of FIG. 1 illustrates the use of mechanical ball float valves 34 and 35 within containers 10 and 11, respectively, to close the drains or entrances to the discharge conduits 13 and 19, respectively, when either container reaches empty condition, as illustrated by container 11 in FIG. 1. This prevents any gas, such as air, from entering the circulation conduit and also isolates the circulation conduit from the gas pressure which exists within the container, which is supplying the liquid thereto. Since the ball of each valve floats in the circulation liquid, the ball permits the free discharge of the circulation liquid until the liquid level is at or below the level which permits the ball to become seated and to seal the nearly empty container before any gas can enter the discharge conduit, as shown by means of broken lines in container 11.

The apparatus of FIG. 1 also illustrates the use of electrical ball float switch valves 36 and 37 associated with the condenser conduits 31 and 32, respectively, and each of which is associated with the solenoid valves 26 and 27, respectively, of the vacuum conduit 28 and with the solenoid valves 23 and 24, respectively, of the air pressure conduit 25. As shown in FIG. 1, switch valve 36 is activated when the container 10 reaches filled condition, the ball float of each valve being buoyant on the surface of the liquid within each container and floating into contact with a switch within its housing to activate each of the solenoid valves 23, 24, 26 and 27. The activation of switch valve 36 causes the vacuum conduit 28 to open to container 11 and close to container 10 and causes the air pressure conduit 25 to close the container 11 and open to container 10, which is the filled container, chainging said container 10 from reduced to elevated pressure, and causing the liquid to begin circulation out of said container 10. Switch valves 36 and 37 also prevent any liquid from being drawn up out of the filled container into the condenser and vacuum conduit.

The preferred apparatus of FIG. 1 also includes a liquid replenishment tank 38 which permits the system to be drained, if necessary, such as for repair work on containers 10 and 11, and which automatically provides the system with the necessary volume of circulation liquid. Associated with the replenishment tank 38 is a coolant tank 39 which is connected to the inlet mold circulation conduit 40 by means of a solenoid valve 41 which is thermostatically controlled in order to open only when the temperature of the circulation liquid is excessive and is to be reduced by passage of the circulation liquid through the coolant tank 39.

As shown by FIG. 1, the liquid replenishment tank 38 is provided with a vent 42 to the atmosphere and with a fill port 43 which can be connected to a drum of supply liquid. Tank 38 is connected to the coolant tank 39 by means of a fill conduit 44 having a ball float valve to prevent liquid from flowing by gravity to fill the coolant tank 39 and the entire circulation system including the container 10 or 11 which is under reduced pressure.

As shown, the coolant tank 39 is connected to the heater conduit 45 by means of a heater bypass conduit 46 which permits the circulation liquid to flow in a counterclockwise direction during the initial filling operation and in a clockwise direction when the system is being drained or during each cooling sequence when the system is in operation, as will be discussed hereafter.

Replenishment 38 is also connected to the coolant tank 39 by means of a drain conduit 47 provided with a mechanical valve 48. The entire system can be drained back into the replenishment tank 38 by opening valve 48 and closing mechanical valve 49 on the inlet mold circulation conduit 40 to cause the air pressure within the filled container, 10 or 11, to force the liquid back through the heater bypass conduit 46, into coolant tank 39 and up the drain conduit 47 into the replenishment tank 38.

The coolant tank 39 contains coolant coils through which cold water or other liquid coolant is circulated to cool the hot circulation liquid present in the tank 39. Cooled circulation liquid does not flow from the tank 39 into the inlet mold conduit 40 until the valve 41 is actuated to open position by means of a heat sensor. Since the heater 15 represents an obstruction to the flow of the circulation liquid, due to the presence of a myriad of electrical heating pipes or coils within the heater, most of the circulation liquid will follow the path of least resistance when the solenoid valve 41 is opened. Thus, most of the circulation liquid being dispensed from container 10 or 11 will bypass the heater 15 and will flow clockwise through the bypass conduit 46, through the coolant tank 39 and through the open solenoid valve 41 into the inlet mold conduit 40. As soon as the circulation liquid has been cooled to the desired temperature, as determined by a heat sensor located somewhere in the system, such as in the containers 10 and 11, the solenoid valve 41 will be actuated to closed position to stop the flow of liquid out of the coolant tank and thereby stop the flow of liquid out of the coolant tank and thereby stop the flow of circulation liquid into the bypass conduit 46. Also, it is noted that the solenoid valve is only open to the passage of cooled circulation liquid.

Also connecting the replenishment tank 38 and the coolant tank 39 is an air vent conduit 50 which permits the release of any air contained within the circulation liquid to escape into the vented replenishment tank 38 above the level of the circulation liquid contained therein. Air entrapment and release is most important in cases where the lower pressure within the container 10 or 11 which is receiving the circulation liquid back from the mold is under a negative pressure or vacuum so that the circulation liquid passing through the mold is also under a negative pressure. This is a preferred embodiment since it prevents leakage of the circulation liquid into the mold cavity through any cracks which may be present in the walls of the mold. In such cases some air will be drawn into the circulation liquid from the mold cavity through said cracks and will be released from the liquids as it seeks the most elevated point of the circulation liquid, i.e., the exit of the air vent conduit 50.

Most of such trapped air will escape from the containers 10 and 11 into the vacuum conduit, during evacuation. Also, the air separates easily from the circulation liquid because it is not emulsified therein, as happens during passage through a mechanical pump.

Finally, with respect to FIG. 1, the mold conduit may be drained when necessary by closing valve 49 to inlet conduit 40 to displace the circulation liquid which will be drawn through the return conduit into container 10 or 11. Also, if desired, the replenishment tank 38 can be located at a level below the level of the mold and of containers 10 and 11 so that the system can be drained by gravity flow into tank 38 in the event that drainage of the entire circulation system is required.

Figures 2, 3, 4:
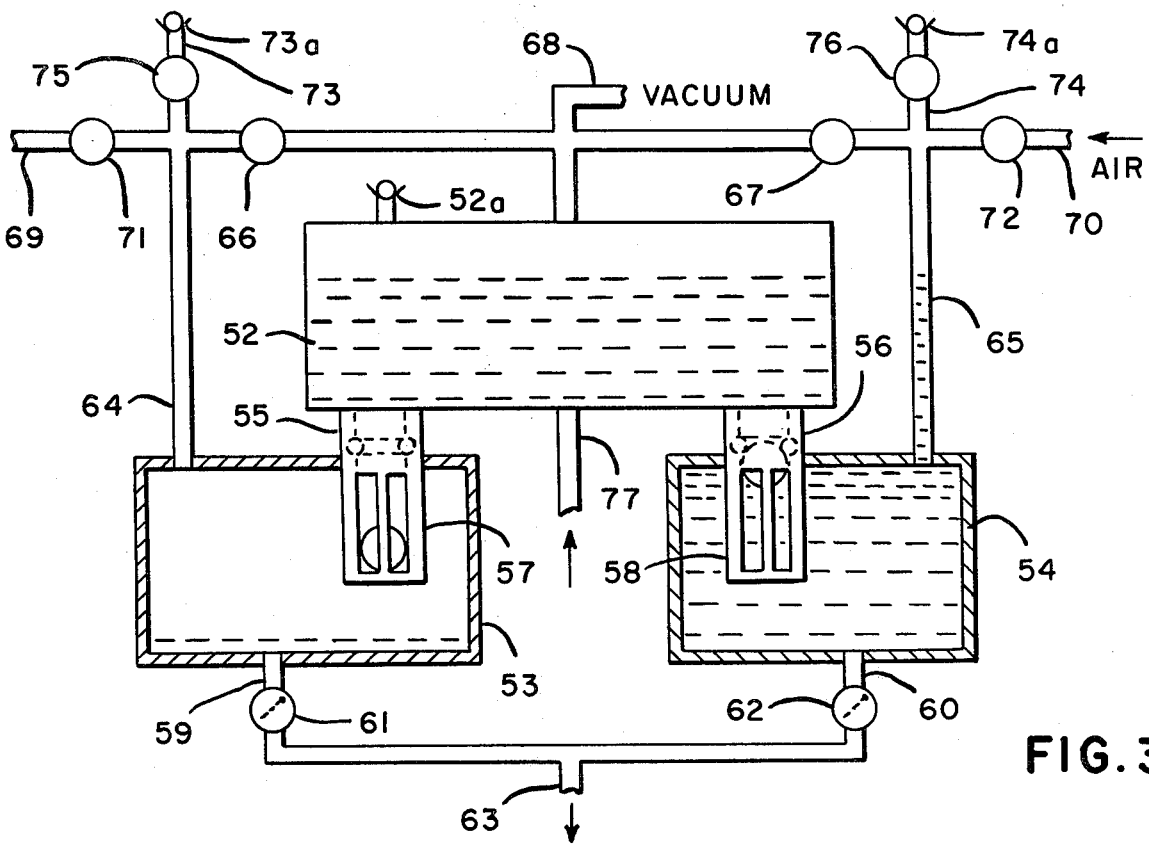
FIG. 2 is a chart illustrating the various concurrent conditions of the air-flow valves of the two containers of FIG. 1 during the complete cycle of operation of the apparatus of FIG. 1.
FIG. 3 is a diagrammatic illustration of a system according to another embodiment of the present invention.
FIG. 4 is a chart illustrating the various concurrent conditions of the air-flow valves of the two containers of FIG. 3 during the complete cycle of operation of the apparatus of FIG. 3.

FIG. 2 illustrates the sequence of operation of the solenoid valves 26, 23, 24 and 27 during the complete cycle of operation of the apparatus of FIG. 1, the solenoid valves being activated by level-detecting switches 36 and 37 which sense the filling condition of the containers 10 and 11. In FIGS. 2 and 4, the + signs indicate the open or ON condition of the respective valves and the − signs indicate the closed or OFF condition of the respective valves.

As shown by FIG. 2, during the portion of the cycle when the container 10 is pressurized and is dispensing liquid 12 through the heater 15 for reheating, through the inlet mold conduit 40 and back through the return line 16 to the container 11, which is under vacuum conditions, the air pressure conduit 25 is open to container 10 by the ON condition of valve 23 but is closed to the container 11 by the OFF condition of valve 24. Conversely, the vacuum conduit 28 is closed to container 10 by the OFF condition of valve 26 but is open to the container 11 by the ON condition of valve 27. These valve conditions subject container 10 to a pressure which is above atmospheric, i.e., from about 20 psi up to about 150 psi and most preferably between about 20 psi and 50 psi, while subjecting container 11 to lower pressure which preferably is below atmospheric but which is only required to be less than the degree of pressure in container 10. Sub-atmospheric pressures are preferred where the work station is a mold and it is desired to prevent the circulating liquid from entering the mold cavity via any cracks which may be present in the mold sections. In such cases it is preferred to maintain a sufficient vacuum in the receptor container, i.e., between about 0 psi and 10 psi, so that the liquid in the return line 16 and within the mold conduit is at least slightly below atmospheric pressure.

The solenoid valves preferably are maintained in the indicated conditions until valves 24 and 27 are activated for an Interim Period of one or more seconds to pressurize container 11. The activation of valves 24 and 27 to the conditions shown may be caused by timer means or by an electronic means which senses the empty condition of container 10 and/or the full condition of container 11, i.e., ball float switch 37. During the brief Interim Period the liquid continues to be circulated from containers 10 to the heater 15, mold, and return line 16, but it is drawn into the accumulator tank 33 which remains under the vacuum pressure which previously existed in container 11.

Upon completion of the Interim Period, timer means actuate the solenoid valves 26 and 23 of the container 10, which is now substantially empty, in order to close said container to the pressure conduit 25 and open it to the vacuum conduit 28 to cause the pressure within container 10 to become lowered while container 11 is pressurized. When the pressure within container 10 is reduced below the vacuum pressure within the accumulator tank 33, the flow control valve 22 opens to admit the liquid from tank 33 and directly from the return line 16. Also, the reduction in the pressure within container 10 causes its discharge flow control valve 14 to close while the discharge flow control valve 20 of container 11 is forced open by the pressure within said container, whereby the liquid 12 flows from container 11, through the heater 15, mold and return line 16 and is sucked in through the return conduit 21 and flow control valve 22 to the receptor container 10.

When container 10 is nearly full and/or container 11 is nearly empty, as determined by timer means or level sensing means, solenoid valves 26 and 23 are activated for an Interim Period to convert the receptor container 10 from vacuum to pressurized condition, thereby stopping the flow of returning liquid to container 10 and causing the liquid to enter the accumulator tank 33.

After a second or two, the solenoid valves 24 and 27 are activated to convert container 11 from pressurized to vacuum conditions and the cycle is repeated.

As previously discussed, the present system merely requires that the pressures capable of being created and alternated within containers 10 and 11 are of sufficient differential as to cause a continuous flow of liquid from one container which, when full is liquid and pressurized is the supply container, to the other container which, when empty and under a lesser pressure than the supply container, is the receptor container. The most essential feature of the invention is the use of differential gas pressures within the two containers to push and pull the liquid through the system without the necessity of passing the liquid through a mechanical flow-inducing device, more commonly referred to as a mechanical pump.

The embodiment of FIGS. 3 and 4 involves a system which is preferred from the standpoint of simplicity. The apparatus of FIG. 3 comprises a liquid reservoir 52 connected to two liquid containers 53 ahd 54 by means of wide inlet conduits 55 and 56, each containing a flow control valve 57 and 58, respectively, each comprising a lightweight metallic sphere confined within an open cage. Containers 53 and 54 are also provided with outlet conduits 59 and 60, each provided with conventional flow control valves 61 and 62, respectively. The outlet conduits 59 and 60 open into the common mold inlet conduit 63, which conduit 63 may be similar to conduit 45 of FIG. 1 and include connection to the heater 15, chiller 39, reservoir tank 38 and bypass conduit 46 illustrated by FIG. 1.

The air space of the reservoir 52 of FIG. 3 is vented by means of a check valve **52*a* to maintain it at no more than atmospheric pressure, and is connected to the containers 53 and 54 by means of air conduits 64 and 65 containing solenoid valves 66 and 67, respectively, so that either container 53 or 54 can be opened to the air pressure within the reservoir 52 which is maintained under a vacuum pressure by connection to a main vacuum conduit 68. Air conduits 64 and 65 are also connected to air pressure conduits 69 and 70, each provided with a solenoid valve 71 and 72, respectively, and to pressure vent conduits 73 and 74, each provided with solenoid valves 75 and 76, respectively, and with check valves 73*a* and 74*a* which close when the pressure within conduits 73 and 74** is atmospheric or lower.

As can be seen from FIG. 3, either container 53 or 54 can be subjected to pressurized condition by opening solenoid 71 or 72 while closing solenoids 66 and 75 or solenoids 67 and 76. Similarly, either container 53 or 54 can be subjected to vacuum conditions by opening solenoid 66 or 67 while closing solenoids 71 and 75 or solenoids 72 and 76. Also, the pressure within either container 53 or 54 can be released to the atmosphere, rather than into the vacuum conduit, by opening solenoid valve 75 or 76 while closing solenoid valves 66 and 71 or 67 and 72.

As shown by FIG. 3, the return conduit 77 from the mold opens into the reservoir 52 so that the circulation liquid is drawn from the mold back into the reservoir 52 by the vacuum pressure existing within reservoir 52.

The apparatus of FIG. 3 is illustrated with container 54 in filled condition as the supply container and container 53 in empty condition, as the receptor container. In the filled condition the liquid level extends up the air conduit, 64 for container 53 and 65 for container 54, so as to be equal with the liquid level in the reservoir 52. In the empty condition same liquid remains in the container 54, or 53, above the flow control valve 62, or 61, to prevent air from entering the mold inlet conduit 63.

As illustrated, container 54 is under the vacuum pressure existing within the reservoir 52, whereby the liquid is caused to flow through the valve 58 into container 54. Such vacuum pressure is exerted within container 54 by opening solenoid valve 67 while closing solenoid valves 72 and 76. While container 53 was under pressurized condition caused by opening solenoid valve 71 while closing solenoid valves 66 and 75, thereby exposing container 53 and its contents to the desired air pressure the pressurized circulation liquid flowed from container 53 through flow control valve 61 into the mold inlet conduit 63, through the mold heating conduit and back through the mold return conduit 77 into the container 52.

The total quantity of liquid circulated from each container 53 and 54 preferably is regulated by timer means which activate the various solenoid valves to alternate the pressure and vacuum conditions within the containers 53 and 54. Thus, when the timer senses the desired quantity of liquid flow from supply container 54, it activates valve 72 to closed position and valve 76 to open position to release the air pressure from container 54. After a pause of one or two seconds, valves 66 and 76 are activated to closed position and valves 67 and 71 are activated to open position to subject the filled receptor container 53 to pressure conditions and subject the empty container 54 to vacuum conditions. This causes container 53 to change from a receptor container to a supply container and to dispense the circulation liquid into the mold inlet conduit 63 and causes container 54 to change from a supply container to a receptor container and to refill with circulation liquid as the reduced pressure in container 54 permits the liquid to dump or flow rapidly by gravity through the wide flow control valve 58 from the reservoir 52. This flow pattern continues for the predetermined time period, as determined by an adjustable timer, after which the procedure is reversed by the activation of the solenoid valves 72 and 75, to release the air pressure within container 53 and valves 75, 66, 67 and 72 to convert container 53 to vacuum conditions and container 54 from vacuum to pressure conditions to reverse the flow pattern with respect to the containers 53 and 54. The flow control valves 57 and 58 comprise a lightweight, hollow, smooth metal ball which sealingly engages a gasket or O-ring at the opening of the wide conduits 55 and 56 into the containers 53 and 54, respectively, when each container reaches filled condition. The balls preferably are of sufficient weight to float on the liquid so that about one half of the ball is above the liquid level, thereby assuring that each container will be substantially completely filled with liquid to the exclusion of any air. After each filling operation, when the filled container is changed from vacuum to pressure conditions, the flow control valve, 57 or 58, will remain closed since the ball thereof will be held up, against gravity, in seated or closed position because of the pressure differential between tank 52 and the pressurized filled container, 53 or 54. Closed position will be maintained until such pressure differential is removed, i.e., the pressure within container 53 or 54 is released and a vacuum is pulled therein. At such time, the flow control valve 57 or 58 opens by the ball dropping to the bottom of its cage under the effects of gravity to permit liquid to dump quickly through the wide conduit 55 or 56 and wide valve 57 or 58 to quickly fill the container, as illustrated by the position of the ball in valve 57 of FIG. 3 at the instant that container 53 is converted from pressurized to vacuum conditions to cause it to be refilled with liquid from supply reservoir 52. The diameter of conduits 55 and 56 is preferably from about two times to about four or more times the diameter of the circulation conduit 63. For example, the former may have a two-inch diameter and the latter a diameter of one-half or three-quarter inch.

The main advantage of the structure of flow control valves 57 and 58 is that they offer no resistance to the flow of liquid from tank 52 to containers 53 and 54 when they move into open position. Conventional flow control valves are spring-biased into closed position and the spring offers a resistance to the opening thereof. Also, even in full open position the movable flat valve member of conventional flow control valves represents an obstruction to the flow of the liquid therepast whereas the balls of valves 57 and 58 drop a sufficient distance and have rounded surfaces so that no significant resistance or obstruction is presented.

Since the volume of air present in the filled containers 53 or 54 is limited to the small volume of air present in the air conduits 64 or 65 above the liquid level of the supply reservoir, very little energy is lost when the filled container is converted from vacuum to pressure conditions to cause the liquid to begin flowing from the filled container.

Also, since the circulation fluid continuously circulates through the central liquid reservoir 52, the temperature of the liquid can be maintained consistent by providing heating and cooling means in or associated with the reservoir 52.

FIG. 4 illustrates the sequence of operation of the solenoid valves for the containers 53 and 54 for the filled or empty interim periods and for the periods during which each container is under pressurized dispensing condition, plus signs indicating the open condition of valves. When each container reaches empty condition, it is closed to the air pressure conduit, 69 or 70, and open to the vent conduit 73 or 74, to release the air pressure and stop the further flow of liquid from said container. Thus, for a brief interim period of one or more seconds, the empty container is opened to atmospheric pressure to stop the liquid circulation and then is opened to the vacuum at the same time that the full container is opened to the pressure conduit. This causes the circulation liquid to begin flowing immediately from the full container to the mold circuit and causes the empty container to begin filling with more circulation liquid received from the reservoir 52 as soon as the vacuum pressure within the empty container and the weight of the liquid within the reservoir are sufficiently to overcome the vacuum pressure within the container 52, i.e., within a few seconds.

FIG. 4 is self-explanatory in illustrating the alternating open and closed conditions of the various solenoid valves during the cycles of operation of the apparatus of FIG. 3. As discussed hereinbefore, the solenoid valves may be activated to the open and closed positions by timer means, the adjustment of which will depend upon the capacity of the circulation containers 53 and 54 and the flow rate of the circulation liquid through the mold conduit. For example, if the containers have a capacity of five gallons each and the flow rate is twenty gallons per minute, the flow from each tank must be stopped after a period of less than fifteen seconds, so that at least some small residual amount of liquid remains in the empty tank and no air enters the circulation conduit. In such cases the timer may be set to release the pressure in the dispensing container after 10, 12 or 14 seconds, for example, since the volume of liqud circulated from the containers is not critical. However, the greater the volume, the less frequent is the activation of the various solenoid values, i.e., the change-over of each container from pressurized to vacuum conditions.

It will be clear to one skilled in the art that either the high level detecting switches and/or the low level detecting switches may be omitted from the containers 10 and 11 of FIG. 1 or timer means may be used since the volume and flow rate of liquid being circulated from one container to the next is determinable and relatively constant. When the supplying container is at the desired low level, the receiving container is at the desired high level, and vice-versa. Thus, the detection of either level is a detection of the other since the containers have the same capacity, and the activation of either switch may be used to reverse the state of the gas inlets and gas outlets of both containers, causing pressurization of the full receiving container and depressurization of the "empty" supplying container. As disclosed above, a slight time delay preferably is incorporated to delay the depressurization of the "empty" supplying container until after the receiving container begins supplying the liquid to the stand-by container of FIG. 1.

It should be understood that the present liquid conduit system is continuously full of the circulation liquid, to the exclusion of any gas or air. It is only the path or flow pattern of the liquid which changes due to the suction pressure within the return conduit 63 being influenced by only one container at a time, i.e., the container under vacuum pressure at the instant that the liquid begins to flow from one of the other containers.

While the present invention is primarily concerned with a mold heating system provided with heating means to reheat the circulated liquid to the desired temperature, i.e., as high as 450° F. or more, after the liquid has passed through the heat-transfer passages of the mold and has transferred some of its heat to the mold, it should be understood that the present invention applies equally well to any system in which liquid is to be treated after circulation in order to restore its functional property prior to recirculation. Thus the liquid containers or the circulation conduit may be provided with cooling means to reduce the temperature of the liquid to a desired level, such as in the case of a mold-cooling operation, or with purifying means, filter means, concentration-regulating means or any other means for restoring the temperature, purity, concentration or other functional properties of the circulation liquid to a required recirculation condition without the liquid having to pass through flow-inducing elements such as mechanical pumps which might be damaged by the temperature or corrosive nature of the liquid.

The present work station need not be a mold heating or cooling station. It may be any work station in which the liquid accomplishes a desired function and, in the process, has a desired property thereof reduced, thereby requiring that such property be restored before the liquid is recirculated.

As in FIG. 1, the gas conduits 69 and 70 of FIG. 3 may conveniently be connected to a common pressurized gas source, such as an air tank maintained at a suitable elevated pressure. In the case of hot oil as a circulation liquid, it has been found that a pressure of about 40 psi is sufficient. However, other liquids may require higher pressures. Also, the rate of circulation may be increased, where desirable, by providing a greater differential between the elevated pressure in the supply container and the reduced pressure in the receptor container.

In place of the level detection switches of FIG. 1 or the timer means of FIG. 3, a single external weight detection switch may be used for each container to activate the solenoid valves for the gas inlets and outlets when the weight of the liquid in any container reaches maximum and minimum limits.

While FIGS. 1 and 3 illustrate a system in which two or more spaced containers are employed, it should be understood that such containers may, in fact, be attached to one another in side-by-side relation so as to be, in effect, isolated compartments of a single container.

If desired, the vacuum conduit 28 of FIG. 1 may be provided with a release valve, similar to valves 75 and 76 of FIG. 3, in order to release the air, evacuated from each container when it is changed over from pressurized to depressurized condition, into the atmosphere. This is advantageous in cases where the outlets are connected to a vacuum tank or pump since it isolates the discharged air from the vacuum source to prevent depletion of the vacuum and unnecessary overworking of the vacuum pump.

It is also possible to use gasses other than air to create the elevated pressures used according to the present invention. Since some circulation liquids, such as oils, may be reactive with air and/or may oxidize in the presence of the oxygen present in air, it may be desirable to use a closed gas-circulation system in which the gas is nitrogen or other gas which is inert with respect to the particular liquid used.

If desired, the circulation liquid may be dispensed from the present supply containers to the mold circulation conduit by means of a discharge conduit or tube which sealingly engages and passes down through the top surface of each container so that the opening of the tube is proximate the inside floor of the container. This avoids the need for any discharge opening in the floor of the supply containers and prevents leakage of the circulation liquid from any poor connection between the floor and such a discharge opening. The sealing engagement between the discharge tube and the top surface of the container is present in the air space or head space of the apparatus of FIG. 1 and, therefore, is unaffected by the nature of the circulation liquid and will not permit the liquid to escape even if the seal deteriorates.

If desired, the means used to heat and/or cool the circulation liquid, such as the electrical heating elements of heater 15 and/or the cooling coils of cooling tank 39 of FIG. 1 may be located within the containers 10 and 11 of FIG. 1 or containers 52, 53 or 54 of FIG. 3, thereby eleiminating the need for the heater 15 and/or the cooling tank 39, reducing the number of connections present in the circulation system and reducing the number of potential leakage points.

Variations and modifications within the scope of the present claims will be apparent to those skilled in the art in the light of the present disclosure.

I claim:

1. Method for causing the rapid recirculation of a liquid between a plurality of containers solely by adjusting the pressure of a gas exerted within each of said containers to superatmospheric, atmospheric and subatmospheric pressure, comprising providing a closed liquid circulation device including said plurality of containers and a liquid circulation system comprising a circulation conduit which communicates with each of said containers and which incorporates a work station, substantially filling a first container and said liquid circulation conduit with a circulation liquid while retaining the other container(s) substantially empty of said liquid, subjecting said filled container to superatmospheric pressure to force substantially all of said liquid out of said filled container and into said circulation conduit to said work station while subjecting a second container to subatmospheric pressure to such said liquid out of said circulation system to substantially fill said second container, opening said first container to atmospheric pressure to relieve the superatmospheric pressure therefrom, subjecting said first container or another container which is at atmospheric pressure to subatmospheric pressure, closing said filled second container to subatmospheric pressure and opening it to superatmospheric pressure to force substantially all of said liquid out to empty said second container into said circulation conduit to said work station, the subatmospheric pressure within said first or other container causing said liquid to be sucked from said circulation system to fill said first or other container, opening said empty second container to atmospheric pressure to relieve the superatmospheric pressure therefrom, closing said second container to atmospheric pressure and then subjecting it or another container which is under atmospheric pressure to subatmospheric pressure while closing said filled container to subatmospheric pressure and opening it to superatmospheric pressure to cause the recirculation of said liquid from said filled container, through said liquid circulation system into said second or other container which is under subatmospheric pressure.

2. Method according to claim 1 in which said liquid circulation system further comprises a liquid circulation reservoir which communicates with each of said containers, maintaining said reservoir under an intermediate gas pressure which is lower than said superatmospheric pressure to cause at least some of the liquid which is circulating from one container to the other to enter said reservoir before the gas pressure in said other container is reduced to a subatmospheric pressure lower than said intermediate gas pressure to cause at least a portion of said liquid to be sucked from said circulation reservoir into said other container.

3. Method according to claim 1 in which said liquid circulation system further comprises a bypass segment which opens into said circulation conduit and which includes means for adjusting the temperature of the circulation liquid, and causing said liquid to flow through said bypass segment to adjust the temperature of said liquid to a desired level.

4. Method according to claim 1 in which said liquid is a heated liquid, said work station comprises a mold heating conduit and heating means are provided in said circulation conduit to heat said liquid to a desired mold-heating temperature.

5. Method according to claim 4 in which said subatmospheric pressure is sufficient to maintain the circulation liquid within said mold heating conduit under a vacuum pressure.

6. Method according to claim 1 which comprises maintaining said circulation conduit filled with the liquid at all times, sensing the desired volume of the liquid circulated out of each said container, and then opening each said container to atmospheric pressure to discontinue circulation out of each said container before each said container is completely empty.

7. Method according to claim 1 which comprises maintaining said liquid circulation conduit open to a source of circulation liquid to permit additional circulation liquid to enter said conduit from said source whenever the pressure of the liquid within said conduit is lower than the pressure at said source.

8. Method according to claim 3 in which said liquid circulation system comprises heating means which are bypassed by said bypass segment, and said bypass segment comprises cooling means, and opening said bypass segment to bypass said heating means whenever said circulation liquid is to be cooled.

9. Method according to claim 7 in which said liquid source comprises a liquid replenishment tank which permits liquid to be drawn into said liquid circulation conduit whenever the pressure within said conduit is lower than the pressure within said replenishment tank.

10. Method according to claim 9 which comprises applying pressure to the liquid within said containers and said liquid circulation conduit to force all of the circulation liquid into said replenishment tank to drain the system.

11. Method according to claim 2 in which each of said containers is provided with a flow control element which is buoyant at the surface of the circulation liquid, introducing liquid from said liquid circulation reservoir to the container being filled to cause the bouyant flow control element of said container to seal the inlet connection between said container and said reservoir when said container is in filled condition, increasing the pressure within said filled container above the pressure within said reservoir to cause the flow control element to continue to seal said inlet connection until said container is substantially empty, and reducing the pressure within said container to or below the pressure within said reservoir to cause the bouyant flow control element to release sealing engagement with the inlet connection to permit liquid to flow from said reservoir back into said container.

12. Apparatus for causing the rapid recirculation of a liquid between a plurality of containers solely by adjusting the pressure of a gas exerted within each of said containers to superatmospheric, atmospheric and subatmospheric pressures, comprising a closed liquid circulation apparatus having a first container, at least one second container and a liquid circulation system comprising a circulation conduit which communicates with each of said containers and which incorporates a work station, one of said containers and said liquid circulation conduit being substantially filled with a circulation liquid while the other container(s) are substantially empty of said liquid, pressure means associated with each of said containers for subjecting each said container, when filled with said liquid, to superatmospheric pressure to force substantially all of said liquid out of said container and into said circulation conduit to said work station, vacuum means associated with each of said containers for subjecting each said container, when empty of said liquid, to subatmospheric pressure to suck liquid out of said circulation system to substantially fill said empty container, relief means associated with each said container for opening and closing each said container, when empty of said liquid to atmospheric pressure to relieve the superatmospheric pressure therefrom prior to activation of said vacuum means, and means for alternating the activation of each said pressure means, vacuum means and relief means so that only one said container at a time is subjected to the maximum superatmospheric pressure and is dispensing said liquid and only one said container at a time is subjected to the maximum vacuum pressure and is receiving said liquid.

13. Apparatus according to claim 12 in which said liquid circulation system further comprises a liquid circulation reservoir having an inlet which is connected to the outlet of said liquid circulation conduit and having an outlet which is connected to each said container, means for maintaining a constant reduced pressure within said reservoir which is intermediate said superatmospheric and subatmospheric pressures to cause circulation liquid to be drawn into said reservoir from said conduit, and means for discharging said circulation liquid from the outlet of said reservoir into an empty container when the pressure within said empty container is reduced to said subatmospheric pressure to overcome the reduced pressure holding said liquid in said reservoir.

14. Apparatus according to claim 13 in which said liquid circulation conduit has an inlet connected to each of said containers and has an outlet which communicates with said circulation reservoir which has outlet means connecting said reservoir to each of said containers, and means for individually alternating the pressure in each of said containers, whereby when circulation liquid is contained within a filled container and the pressure within said filled container is increased to superatmospheric so that said reservoir is at a lower pressure than the pressure in said filled container, said liquid will circulate from said filled container, through said liquid conduit and into said reservoir and from said reservoir into an empty second container when the pressure within said empty container is reduced to said subatmospheric presure to draw said liquid from said reservoir.

15. Apparatus according to claim 13 which comprises pressure-sensitive valve means connecting each said container to the outlet of said circulation reservoir.

16. Apparatus according to claim 12 in which said work station comprises a mold heating conduit and said apparatus includes means for heating said circulation liquid.

17. Apparatus according to claim 16 which comprises means for maintaining the subatmospheric pressure as a sufficient vacuum to maintain the circulation liquid within said mold heating conduit under vacuum pressure.

18. Apparatus according to claim 12 comprising a liquid supply conduit which is open to a first area of said circulation conduit to admit supply liquid to said circulation conduit.

19. Apparatus according to claim 18 comprising a liquid replenishment tank which is open to said liquid supply conduit.

20. Apparatus according to claim 18 in which said liquid supply conduit comprises a liquid bypass conduit which also communicates with a second area of said circulation conduit, heater means are present in said circulation conduit between said first and second areas thereof, and cooling means are present in said supply liquid bypass conduit, and valve means for causing the circulation liquid to bypass said heater means and flow through said bypass conduit and cooling means to cool said circulation liquid to a desired temperature before it is returned to said circulation conduit.

21. Apparatus according to claim 19 which comprises means for applying superatmospheric pressure simultaneously to all of said containers and said liquid circulation system to force all of the circulation liquid into said bypass conduit and replenishment tank to drain the system.

* * * * *

UNITED STATES PATENT AND TRADEMARK OFFICE

CERTIFICATE OF CORRECTION

PATENT NO. : 4,408,960

DATED : October 11, 1983

INVENTOR(S) : Paul E. Allen

It is certified that error appears in the above-identified patent and that said Letters Patent are hereby corrected as shown below:

Col. 2, line 3, starting "The reservoir...", this sentence should read -- The reservoir is open to the container which is under reduced pressure, so as to permit the circulation liquid to flow from the reservoir into said container.--; Col. 2, line 48, "condition" should be --conduit--; col. 5, line 4, the word --tank-- should be inserted between "Replenishment" and "38"; col. 5, line 55 "liquids" should be --liquid--; col. 7, line 17, "is" should be --of--; col. 7, line 31, "ahd" should be --and--; col. 8, line 11, "same" should be --some--; col. 8, line 52, "72" should be --71--; col. 9, line 60, "circuit" should be --conduit--; col. 9, line 64, "sufficiently" should be --sufficient--; claim 1, col. 12, line 24, "such" should be --suck--.

Signed and Sealed this

*Thirty-first* Day of *July 1984*

[SEAL]

*Attest:*

GERALD J. MOSSINGHOFF

*Attesting Officer*

*Commissioner of Patents and Trademarks*